US012798911B2

(12) United States Patent
Ogawa et al.

(10) Patent No.: US 12,798,911 B2
(45) Date of Patent: Nov. 17, 2026

(54) DOCUMENT TRANSPORT DEVICE AND IMAGE FORMING APPARATUS THAT RAISES AND LOWERS DOCUMENT PLACEMENT TRAY

(71) Applicant: KYOCERA Document Solutions Inc., Osaka (JP)

(72) Inventors: Shikitaro Ogawa, Osaka (JP); Takafumi Nakagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 268 days.

(21) Appl. No.: 18/656,739

(22) Filed: May 7, 2024

(65) Prior Publication Data

US 2024/0383699 A1 Nov. 21, 2024

(30) Foreign Application Priority Data

May 15, 2023 (JP) ..... 2023-080381

(51) Int. Cl.
*B65H 1/14* (2006.01)

(52) U.S. Cl.
CPC ..... *B65H 1/14* (2013.01); *B65H 2557/63* (2013.01)

(58) Field of Classification Search
CPC ... B65H 1/08; B65H 1/14; B65H 7/02; B65H 2405/35; B65H 2405/353; H04N 1/00697; H04N 1/00687
USPC ..... 270/58.13, 58.19, 58.28; 271/162
See application file for complete search history.

(56) References Cited

U.S. PATENT DOCUMENTS 5,713,568 A * 2/1998 Tamehira ..... B41J 13/103 271/157
6,354,586 B1 * 3/2002 Samoto ..... B65H 1/14 271/127
11,530,101 B2 * 12/2022 Suwa ..... H04N 1/00588
2003/0085506 A1 5/2003 Kubo

FOREIGN PATENT DOCUMENTS

JP 2003118851 A 4/2003
JP 2022157152 A * 10/2022 ..... H04N 1/00734

* cited by examiner

*Primary Examiner* — Leslie A Nicholson, III
(74) *Attorney, Agent, or Firm* — IP Business Solutions, LLC.

(57) ABSTRACT

A document transport device includes a controller that, when a document detection sensor has detected a document on a document placement tray, controls driving of an elevating mechanism that raises the document placement tray from a lower limit position to an upper limit position to temporarily raise the document placement tray to the upper limit position and then move the document placement tray to a standby position which is a predetermined distance below and stop moving the document placement tray. The standby position is set to a position that is between the upper limit position and the lower limit position and closer to the upper limit position than to the lower limit position.

5 Claims, 8 Drawing Sheets

DOCUMENT TRANSPORT DEVICE AND IMAGE FORMING APPARATUS THAT RAISES AND LOWERS DOCUMENT PLACEMENT TRAY

INCORPORATION BY REFERENCE

This application claims priority to Japanese Patent Application No. 2023-080381 filed on May 15, 2023, the entire contents of which are incorporated by reference herein.

BACKGROUND

The present disclosure relates to a document transport device that transports a document to a document reading device and an image forming apparatus including the document transport device.

Document transport devices that feed a document placed on a document placement tray sheet by sheet using a feeding roller and transport the fed document to a reading position on a document reading device include a document transport device that, upon receiving an instruction to start reading a document from a user, raises a document placement tray to a position (an upper limit position) where a top surface of an uppermost sheet of a document placed on the document placement tray is pressed against a feeding roller.

However, to start reading the document, the document placement tray must be raised a long distance from a lower limit position to the upper limit position because the document placement tray is normally lowered to the lower limit position. Therefore, a long time is required from the user's instruction to start reading a document to the actual start of reading of the document.

For example, a document transport device that raises a support plate of a paper feed tray (a document placement tray) to an upper limit position when a document is placed on the paper feed tray is known.

SUMMARY

An aspect of the present disclosure proposes a technology that is a further improvement of the above technology.

A document transport device according to an aspect of the present disclosure includes an operation device, a document placement tray, a document detection sensor, a document discharge tray, a document transport mechanism, an elevating mechanism, and a controller. The operation device is configured to receive a document reading instruction. The document placement tray is configured to be raised and lowered with a document placed thereon. The document detection sensor is configured to detect the presence or absence of a document on the document placement tray. The document transport mechanism includes a feeding roller provided above the document placement tray and configured to feed a document placed on the document placement tray sheet by sheet and a document reading device configured to read an image of the document fed by the feeding roller and is configured to transport the document fed by the feeding roller to a reading position on the document reading device and discharge the document to the document discharge tray. The elevating mechanism is configured to raise the document placement tray from a lower limit position in the raising and lowering of the document placement tray to an upper limit position where a top surface of an uppermost sheet of the document placed on the document placement tray is pressed against the feeding roller. The controller is configured to, when the document detection sensor has detected a document on the document placement tray, control driving of the elevating mechanism to temporarily raise the document placement tray to the upper limit position and then move the document placement tray from the upper limit position to a standby position which is a predetermined distance below the upper limit position and stop moving the document placement tray, and when the document transport mechanism has transported the document fed by the feeding roller to the reading position upon the operation device receiving a document reading instruction, cause the elevating mechanism to raise the document placement tray again to the upper limit position. The standby position is set to a predetermined position between the upper limit position and the lower limit position.

An image forming apparatus according to an aspect of the present disclosure includes the document transport device according to the above aspect of the present disclosure and an image forming device configured to form an image on a recording medium.

DETAILED DESCRIPTION

Figure 1:
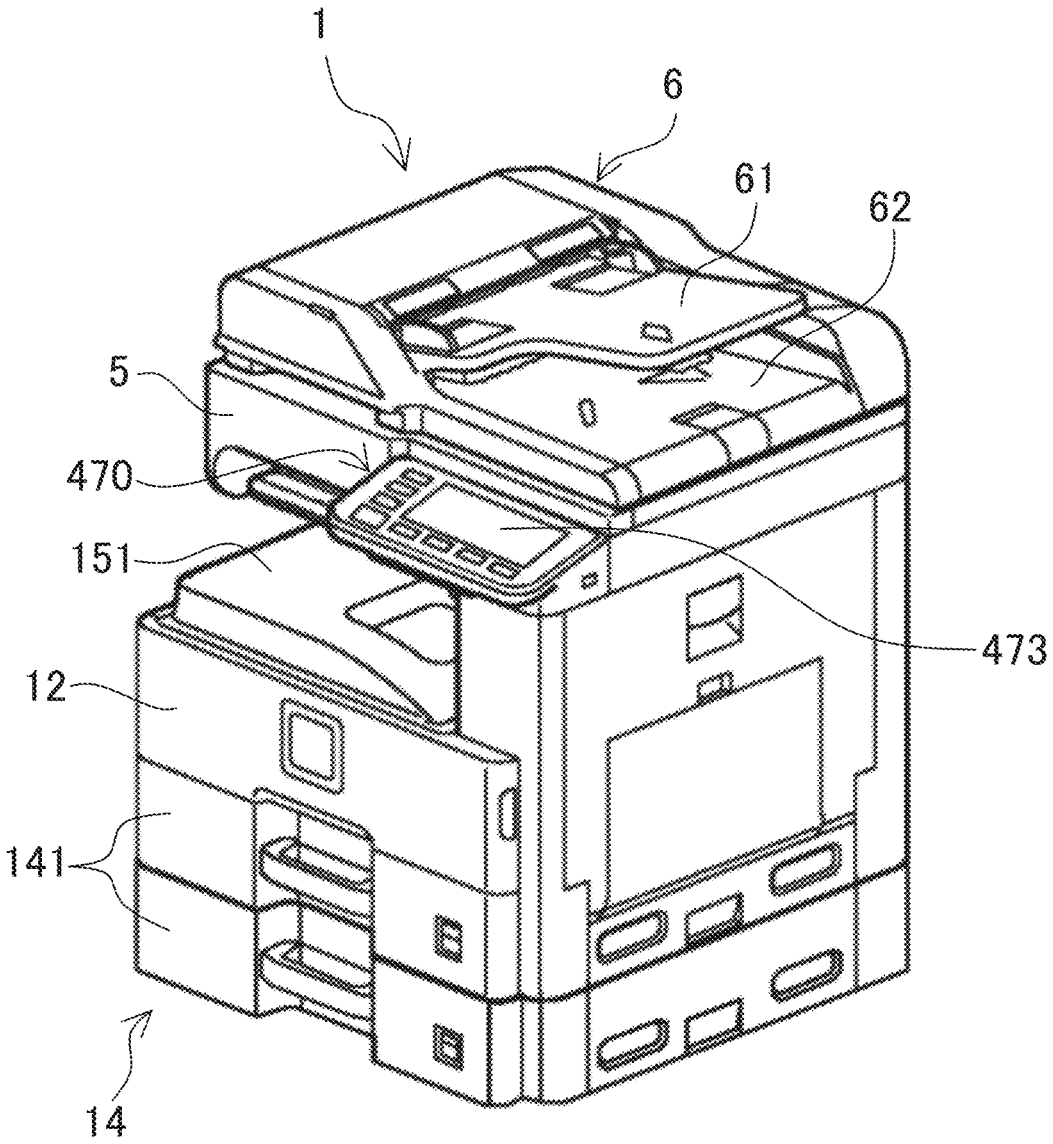
FIG. 1 is a perspective view showing the appearance of an image forming apparatus including a document transport device according to an embodiment of the present disclosure.

A document transport device and an image forming apparatus according to an embodiment which is an aspect of the present disclosure will be described below with reference to the drawings. FIG. 1 is a perspective view showing the appearance of an image forming apparatus including a document transport device according to an embodiment of the present disclosure.

The image forming apparatus 1 is a multifunction device having multiple functions such as a copy function, a printer function, a scanner function, and a facsimile function and includes a document transport device 6, a document reading device 5, an image forming device 12, a paper feed device 14, and an operation device 470.

The document transport device 6 is formed on a top surface of the document reading device 5 such that the document transport device 6 is openable and closable via a hinge or the like (not shown) and functions as a document holding cover when a document placed on platen glass (not shown) is read. The document transport device 6 is called an auto document feeder (ADF) or a document processor (DP)

and includes a document placement tray 61 on which a document is placed and a document discharge tray 62 provided below the document placement tray 61. The document transport device 6 supplies a document placed on the document placement tray 61 sheet by sheet to the document reading device 5 and discharges the document to the document discharge tray 62.

A case where the image forming apparatus 1 performs a document reading operation will be described. The document reading device 5 optically reads an image of a document, which has been supplied to the document reading device 5 by the document transport device 6, or a document placed on the platen glass and generates image data. The image data generated by the document reading device 5 is stored in an image memory or the like (not shown).

A case where the image forming apparatus 1 performs an image forming operation will be described. The image forming device 12 forms a toner image on recording paper, which is a recording medium fed from the paper feed device 14, based on image data generated by the document reading operation or image data received from a computer which is an external device (for example, a personal computer) connected to a network.

The recording paper on which the toner image has been formed by the image forming device 12 is subjected to a fixing process by a fixing device (not shown) and the recording paper that has been subjected to the fixing process is discharged to a discharge tray 151. The paper feed device 14 includes a plurality of paper feed cassettes 141.

The operation device 470 includes hard keys for receiving various instructions from a user. The operation device 470 receives, from the user, instructions regarding various operations and processing that can be performed by the image forming apparatus 1 such as an instruction to perform an image forming operation. The operation device 470 includes a display device 473 that displays operation guidance and the like to the user. The operation device 470 also receives an input of an instruction from the user via a touch panel included in the display device 473 based on the user's operation (touch operation) performed on an operation screen displayed on the display device 473 or the user's operation performed on the hard keys.

The display device 473 includes a liquid crystal display (LCD) or the like. The display device 473 includes the touch panel. When the user has performed an operation of touching a button or key displayed on the screen, the touch panel receives an instruction associated with the position where the touch operation has been performed.

Figure 2:
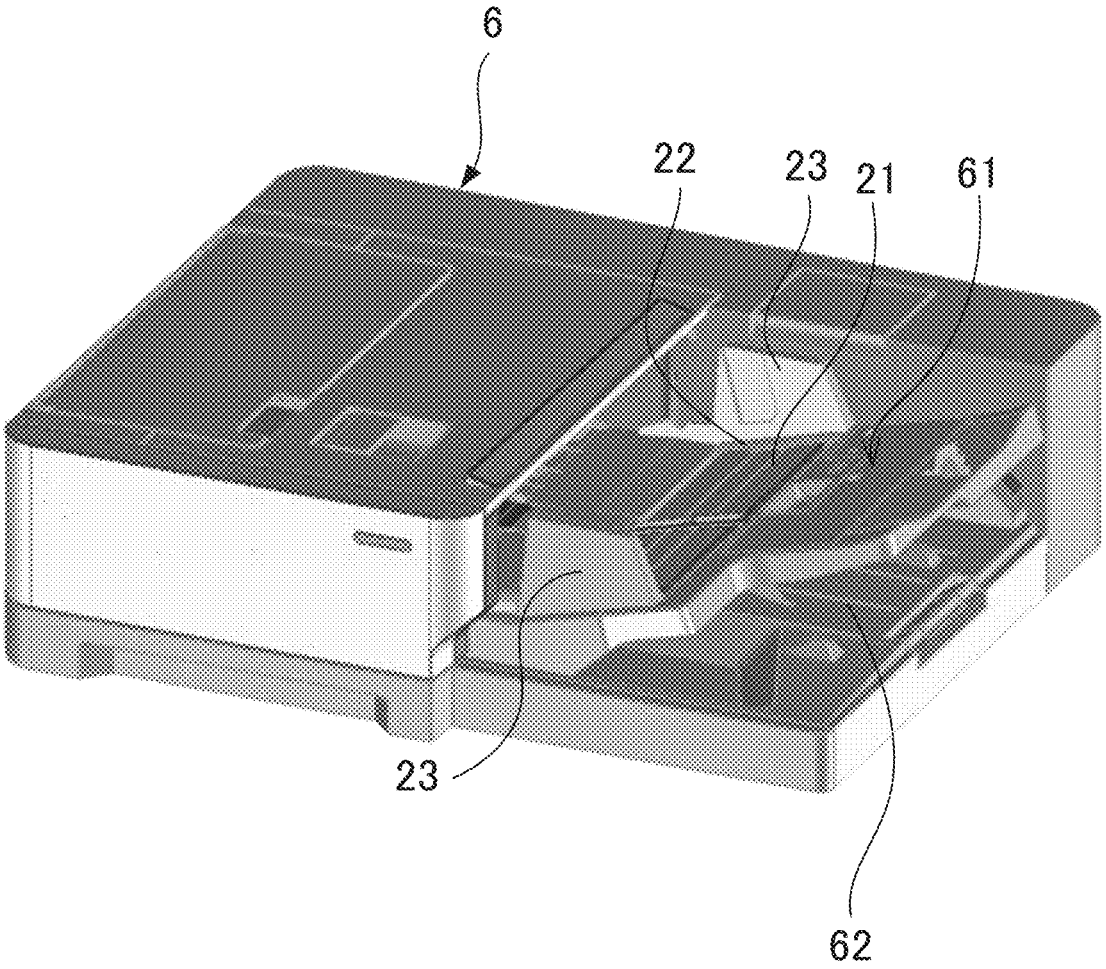
FIG. 2 is a perspective view showing another example of the document transport device.
Figure 3:
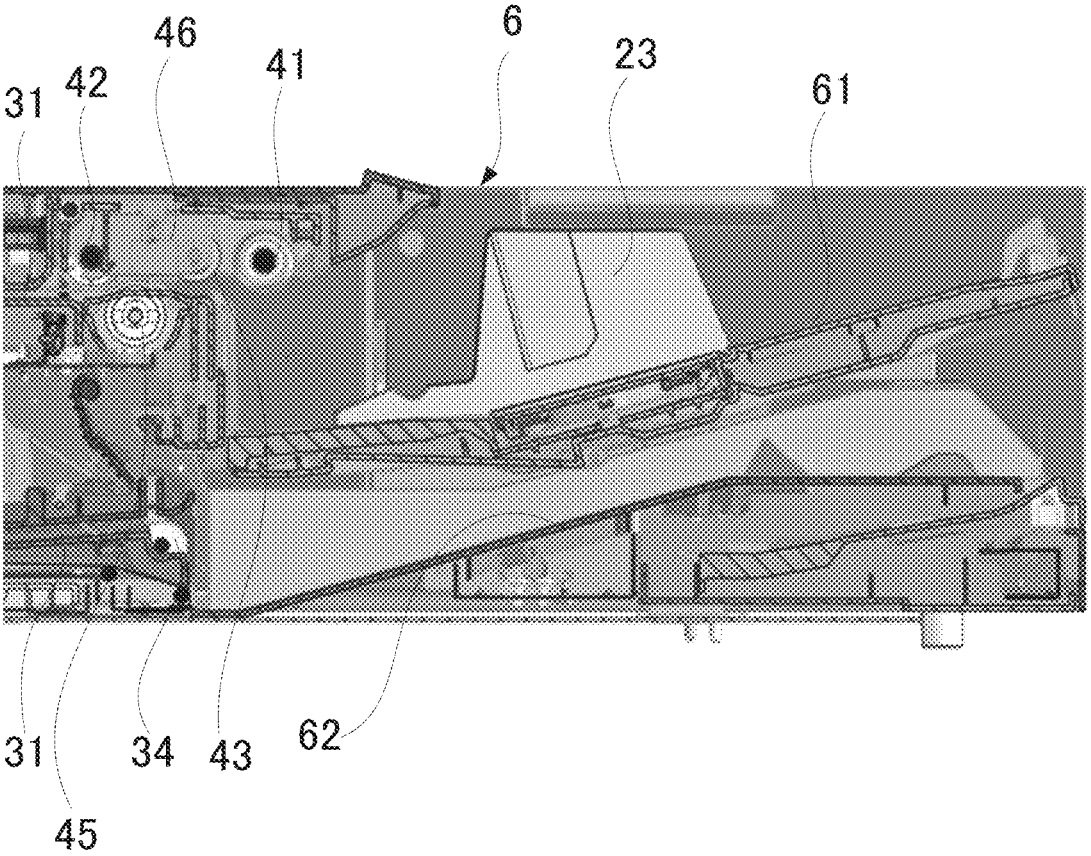
FIG. 3 is a cross-sectional view of the document transport device shown in FIG. 2.
Figure 4:
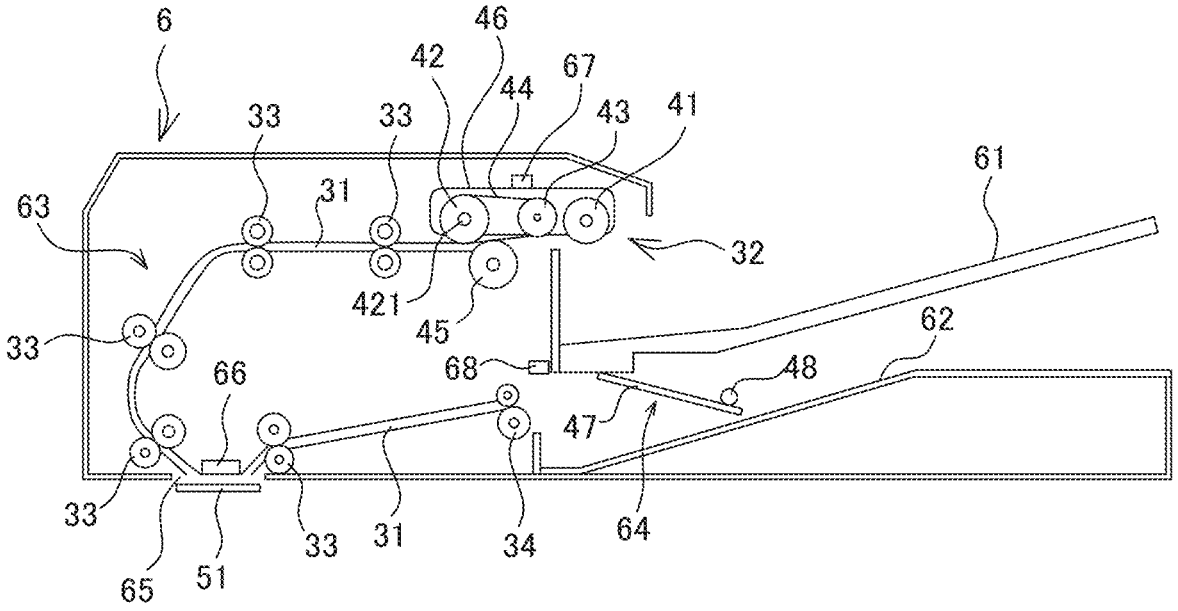
FIG. 4 is a diagram schematically showing a cross section of the document transport device.

FIG. 2 is a perspective view showing another example of the document transport device 6. FIG. 3 is a cross-sectional view of the document transport device 6 shown in FIG. 2. FIG. 4 is a diagram schematically showing a cross section of the document transport device 6.

The document transport device 6 includes a document placement tray 61 on which a document is placed, a document discharge tray 62 provided below the document placement tray 61, a document transport mechanism 63 (FIG. 4) that transports the document placed on the document placement tray 61 to the document discharge tray 62, and an elevating mechanism 64 (FIG. 4) that raises and lowers the document placement tray 61.

The document placement tray 61 includes a document placement table 21 (FIG. 2) on which a document is placed, cursors 22 (FIG. 2) formed on a top surface of the document placement table 21 such that they are slidable in a document width direction perpendicular to a document transport direction, and document width guides 23 (FIG. 2) that are provided upright on the cursors 22 and come into contact with the document placed on the document placement table 21 in the document width direction to regulate the width of the document.

The document transport mechanism 63 includes a document transport path 31, a feeding mechanism 32 for feeding the document placed on the document placement tray 61 sheet by sheet, a plurality of pairs of transport rollers 33 arranged along the document transport path 31, and a pair of discharge rollers 34 for discharging the document to the document discharge tray 62.

The document transport path 31 is open at its lowest end portion. That is, the document transport device 6 has an opening 65 formed on its bottom surface at a portion facing the platen glass 51 which is a reading position on the document reading device 5 (FIG. 1). The document fed by the feeding mechanism 32 and transported along the document transport path 31 is transported to the bottom surface (the opening 65) of the document transport device 6, where the image of the document is read by the document reading device 5. A white plate 66 for shading correction is also provided directly above the opening 65 (at a position directly above the platen glass 51).

The document that has passed by the opening 65 is transported toward the pair of discharge rollers 34 by a pair of transport rollers 33 provided downstream of the opening 65 in the transport direction and is discharged to the document discharge tray 62 by the pair of discharge rollers 34.

The feeding mechanism 32 includes a feeding roller 41 that feeds the document placed on the document placement tray 61 sheet by sheet, a driving roller 42, a driven roller 43, a belt 44 that is wound around the driving roller 42 and the driven roller 43, and an auxiliary roller 45 provided below the belt 44.

The feeding roller 41, the driving roller 42, the driven roller 43, and the belt 44 are provided inside a box-shaped holder 46 that is open at the bottom. The holder 46 is swingable around a drive shaft 421 of the driving roller 42 and the driving force of the drive shaft 421 is transmitted to the feeding roller 41 by a transmission mechanism such as a gear (not shown).

A pressure detection sensor 67 is provided at the top of the holder 46 to detect that an appropriate load has been applied between the top surface of an uppermost sheet of the document placed on the document placement tray 61 and the feeding roller 41. That is, the pressure detection sensor 67 serves as an upper limit sensor that detects that the document placement tray 61 has been raised to an upper limit position where the top surface of the uppermost sheet of the document placed on the document placement tray 61 is pressed against the feeding roller 41. The document transport device 6 also includes a lower limit sensor 68 including a mechanical or optical sensor that detects a lower limit position of the document placement tray 61.

Figure 5A:
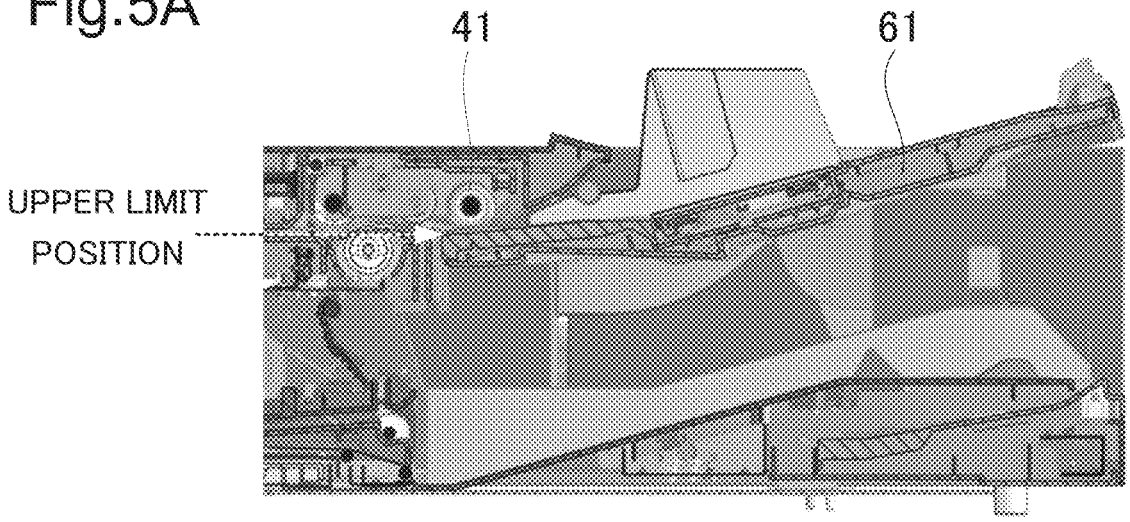
FIG. 5A is a diagram showing a state in which a document placement tray has been raised to an upper limit position and FIG. 5B is a diagram showing a state in which the document placement tray has been lowered to a lower limit position.
Figure 5B:
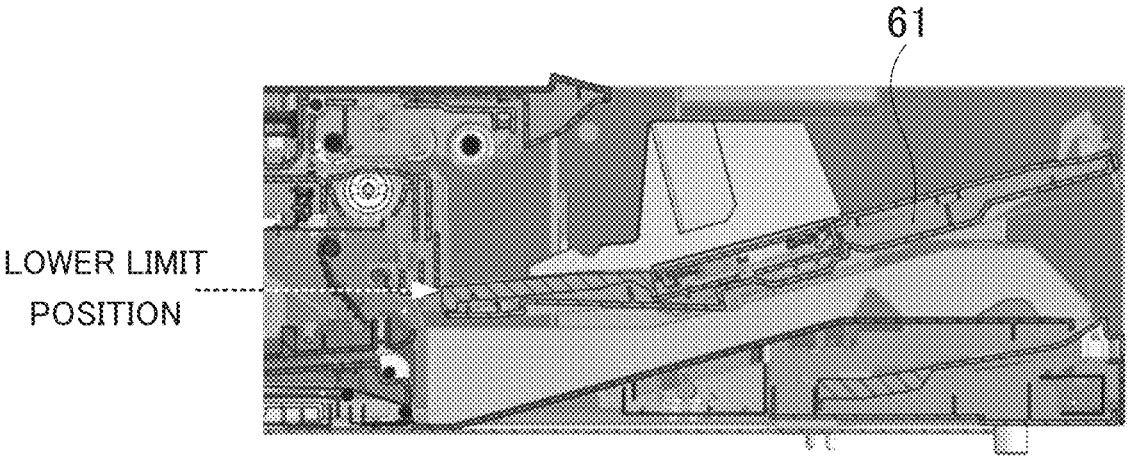

The elevating mechanism 64 includes an elevating lever 47 whose tip abuts against the document placement tray 61 and raises and lowers the document placement tray 61 and a rotating shaft 48 that is connected to a motor (not shown) and rotates the elevating lever 47. FIG. 5(A) shows a state in which the document placement tray 61 has been raised to the upper limit position and FIG. 5(B) shows a state in which the document placement tray 61 has been lowered to the lower limit position.

Figure 6:
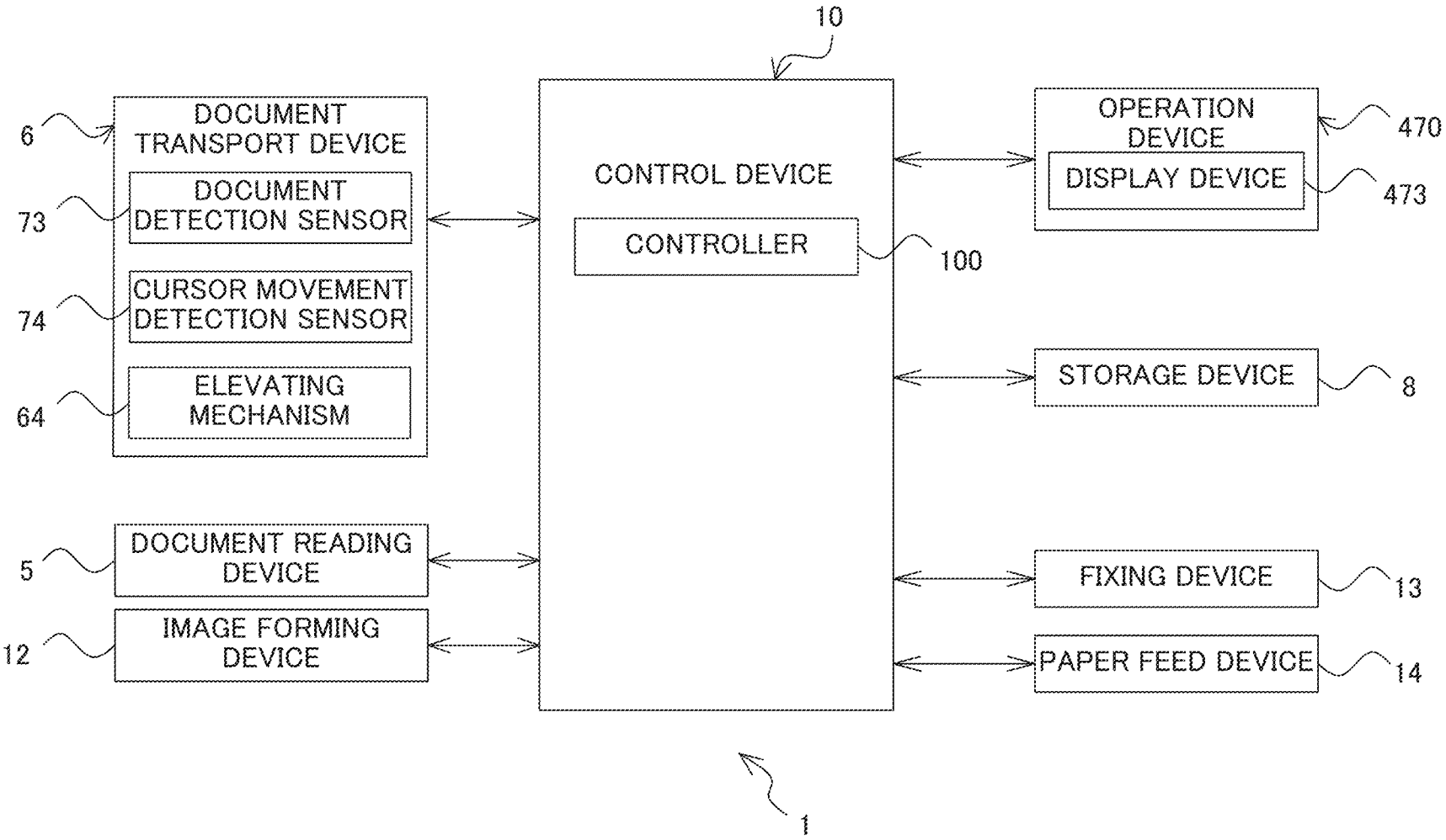
FIG. 6 is a functional block diagram schematically showing a main internal configuration of the image forming apparatus.

FIG. 6 is a functional block diagram schematically showing a main internal configuration of the image forming apparatus 1. The image forming apparatus 1 includes a control device 10, the document transport device 6, the document reading device 5, the image forming device 12, a fixing device 13, the paper feed device 14, the operation device 470, and a storage device 8.

The fixing device 13 heats and presses recording paper on which the toner image has been formed by the image forming device 12 to fix the toner image on the recording paper and the recording paper that has been subjected to the fixing process is discharged to the discharge tray 151 (FIG. 1).

The storage device 8 is a large capacity storage device such as a hard disk drive (HDD) or a solid state drive (SSD) and stores various control programs and the like.

The control device 10 is configured to include a processor, a random access memory (RAM), a read only memory (ROM), and a dedicated hardware circuit. The processor is, for example, a central processing unit (CPU), an application specific integrated circuit (ASIC), or a micro processing unit (MPU). The control device 10 includes a controller 100.

The control device 10 functions as the controller 100 by the processor performing an operation according to a control program stored in the storage device 8. Here, the controller 100 may be formed of a hardware circuit rather than being implemented by the control device 10 performing an operation according to the control program. Hereinafter, the same applies to each embodiment unless otherwise specified.

The controller 100 controls overall operations of the image forming apparatus 1. The controller 100 also controls overall operations of the document transport device 6. The controller 100 is connected to the document transport device 6, the document reading device 5, the image forming device 12, the fixing device 13, the paper feed device 14, the operation device 470, and the storage device 8 and controls driving or the like of each of these devices. For example, the controller 100 performs various processing or the like necessary for the image forming apparatus 1 to perform image forming. The controller 100 is an example of a controller in the claims.

The document transport device 6 includes a document detection sensor 73, a cursor movement detection sensor 74, and the elevating mechanism 64. The document detection sensor 73 is a sensor that detects the presence or absence of a document on the document placement tray 61. The cursor movement detection sensor 74 is a sensor that detects movement of the cursors 22 or the document width guides 23. The cursor movement detection sensor 74 includes a driven roller that is attached to a lower part of each cursor 22, which is a portion thereof below the surface of the document placement tray 61, and rotates as the cursor 22 moves and an optical sensor that detects a mark that is provided on the driven roller and rotates as the driven roller rotates. The controller 100 detects the amount of rotation of the driven roller according to the number of times the optical sensor has detected the mark and calculates the amount of movement and the position after movement of the cursor 22 from the amount of rotation and the position before movement of the cursor 22. The controller 100 determines that the cursor 22 is moving while the optical sensor is detecting the mark.

The document transport device 6 may include the controller 100 as an example of the controller in the claims. Here, the controller 100 functions as a controller for the document transport device 6.

Figure 7:
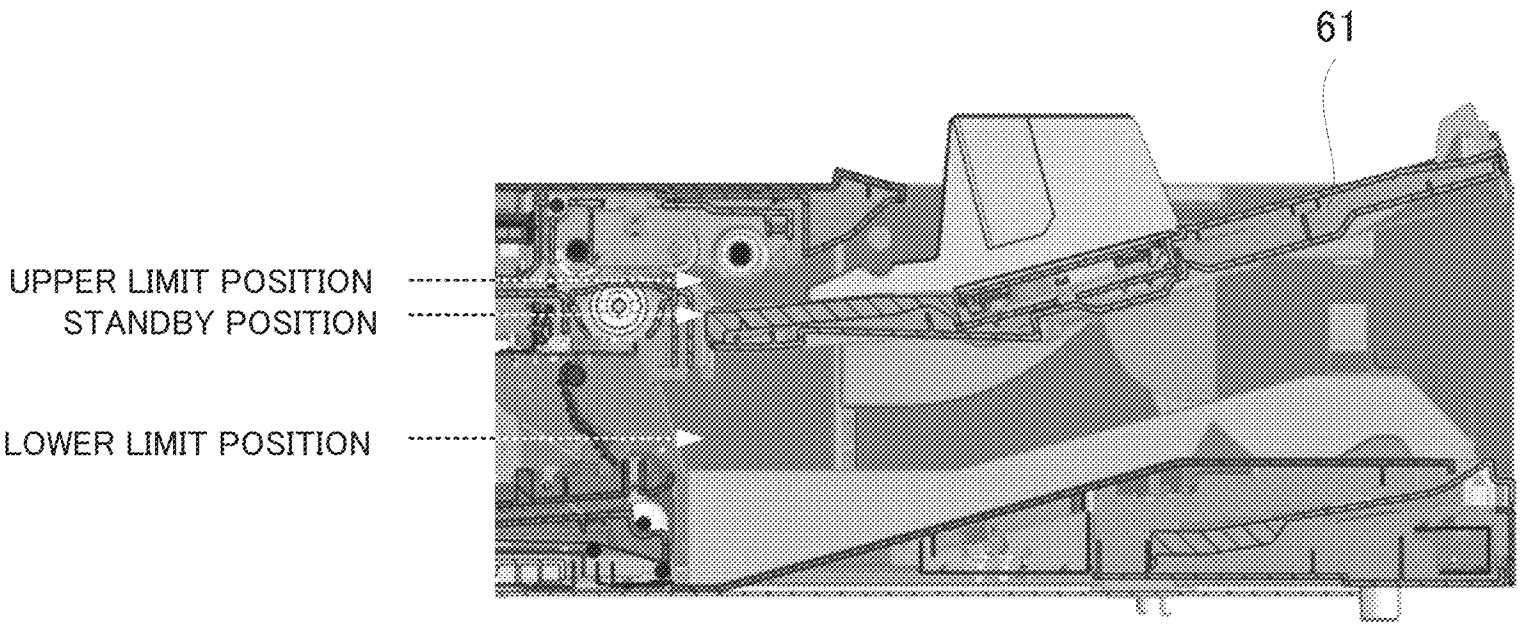
FIG. 7 is a diagram showing a state in which the document placement tray is on standby at a standby position.

When the document detection sensor 73 has detected a document on the document placement tray 61, the controller 100 controls driving of the elevating mechanism 64 to temporarily raise the document placement tray 61 to the upper limit position and then move the document placement tray 61 from the upper limit position to a standby position which is a predetermined distance PD below the upper limit position and stop moving the document placement tray 61. The predetermined distance PD is very small (for example, 5 mm). The standby position is set between the upper limit position and the lower limit position and is most preferably a position closer to the upper limit position than to the lower limit position. FIG. 7 shows a state in which the document placement tray 61 is on standby at the standby position.

Here, the document transport device 6 including the controller 100 as its controller and further including the operation device 470 is an example of a document transport device in the claims.

Figure 8:
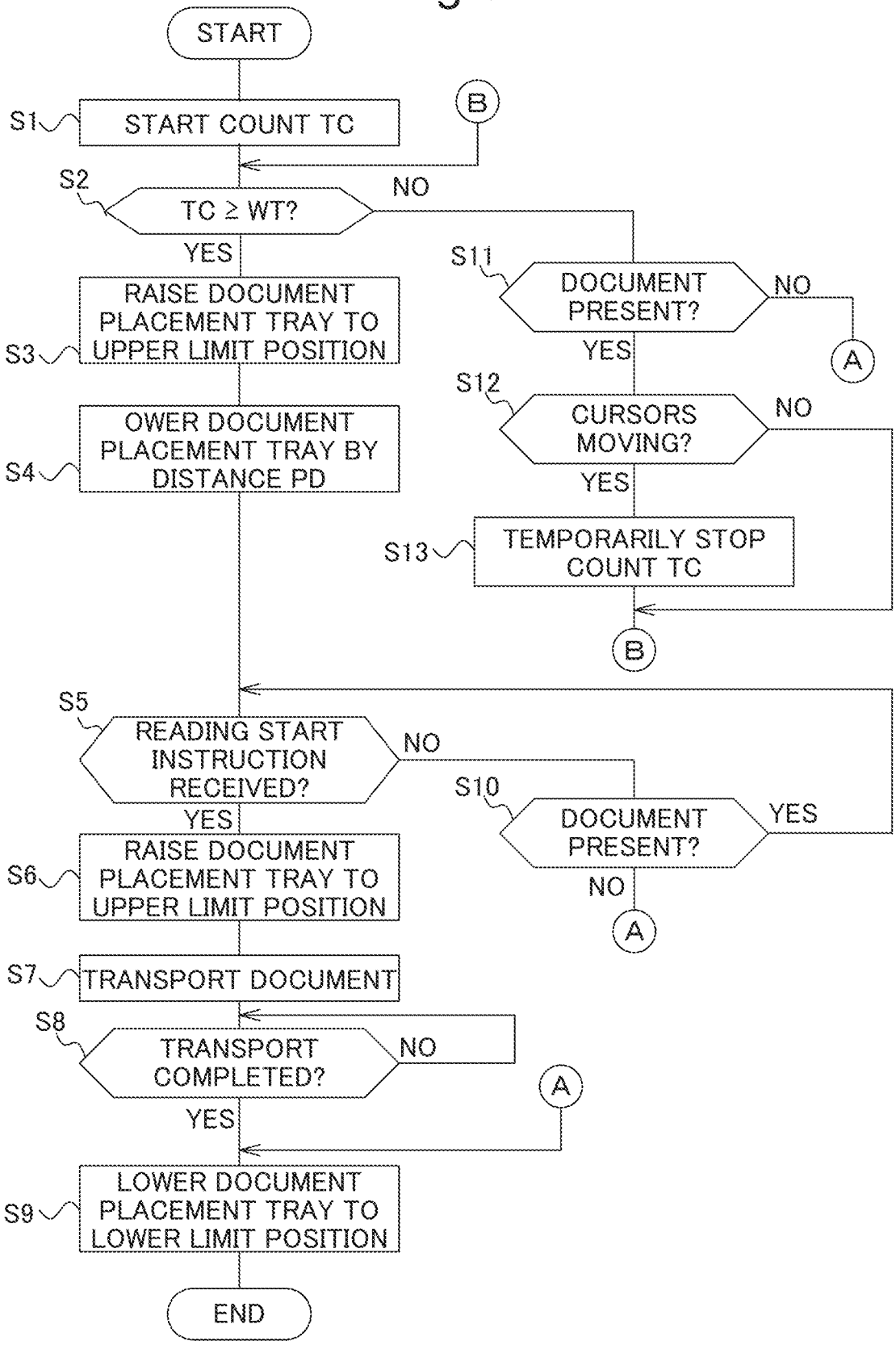
FIG. 8 is a flowchart illustrating an example of control for raising and lowering the document placement tray in the document transport device.

Next, an example of control for raising and lowering the document placement tray 61 in the document transport device 6 will be described using a flowchart shown in FIG. 8. This process is performed when the document detection sensor 73 has detected a document placed on the document placement tray 61.

When the document detection sensor 73 has detected a document on the document placement tray 61, the controller 100 starts a timer count using a timer provided in the document transport device 6 from the time of detection (step S1) and determines whether the count TC has reached a predetermined waiting time WT (step S2).

Upon determining that the count TC has reached the predetermined waiting time WT (YES in step S2), the controller 100 controls driving of the elevating mechanism 64 to raise the document placement tray 61 to the upper limit position (step S3). Specifically, when the pressure detection sensor 67 (FIG. 4) has detected that a load of a certain level or more has been applied to the feeding roller 41, the controller 100 determines that the document placement tray 61 has reached the upper limit position and stops raising the document placement tray 61.

After that, the controller 100 controls driving of the elevating mechanism 64 to move the document placement tray 61 to the standby position which is the predetermined distance PD below and stop moving the document placement tray 61 (step S4).

Subsequently, the controller 100 determines whether a document reading instruction has been received by the operation device 470 (step S5). The operation device 470 receives a user instruction to start scanning or copying a document placed on the document placement tray 61 as a document reading instruction.

Upon determining that a document reading instruction has been received (YES in step S5), the controller 100 controls driving of the elevating mechanism 64 to raise the document placement tray 61 to the upper limit position (step S6) and controls driving of the document transport mechanism 63 to start transporting the document placed on the document placement tray 61 and causes the document reading device 5 to read an image of the document (step S7).

Based on detection by the document detection sensor 73, the controller 100 determines whether the transport of all sheets of the document placed on the document placement tray 61 has been completed (step S8). Upon determining that the transport of the document has been completed (YES in step S8), the controller 100 controls driving of the elevating mechanism 64 to lower the document placement tray 61 to the lower limit position (step S9). After this, the process ends. Specifically, the controller 100 causes the elevating mechanism 64 to continue lowering the document placement tray 61 until the document placement tray 61 is detected by the lower limit sensor 68 (FIG. 4).

On the other hand, upon determining in step S5 that no document reading instruction has been received (NO in step S5), the controller 100 determines whether a document is placed on the document placement tray 61 based on detection by the document detection sensor 73 (step S10).

When the controller 100 has determined that a document is placed on the document placement tray 61 (YES in step S10), the process returns to step S5. On the other hand, upon determining that no document is placed on the document placement tray 61 (that is, the document has been removed from the document placement tray 61) (NO in step S10), the controller 100 controls driving of the elevating mechanism 64 to lower the document placement tray 61 to the lower limit position (step S9). After this, the process ends.

Upon determining in step S2 that the count TC has not reached the predetermined waiting time WT (NO in step S2), the controller 100 determines whether a document is placed on the document placement tray 61 based on detection by the document detection sensor 73 (step S11).

Upon determining that no document is placed on the document placement tray 61 (that is, the document has been removed from the document placement tray 61) (NO in step S11), the controller 100 controls driving of the elevating mechanism 64 to lower the document placement tray 61 to the lower limit position (step S9). After this, the process ends.

On the other hand, upon determining that a document is placed on the document placement tray 61 (YES in step S11), the controller 100 determines whether the cursors 22 are moving based on detection by the cursor movement detection sensor 74 (step S12).

Upon determining that the cursors 22 are moving (the user is arranging the document) (YES in step S12), the controller 100 temporarily stops counting the timer until the cursors 22 stop moving (step S13) and then the process returns to step S2. Here, the controller 100 may not only stop the timer count but also reset the count TC to 0. On the other hand, when the controller 100 has determined that the cursors 22 are not moving (NO in step S12), the process returns to step S2. Also, when the controller 100 has determined that the cursors 22 that have been moving has reached a state where they are not moving (NO in step S12), the process returns to step S2.

According to the above embodiment, when a document on the document placement tray 61 has been detected, the document placement tray 61 is raised without waiting for the user's instruction to start reading a document and placed on standby at a standby position near the upper limit position and therefore it is possible to reduce the time required from the user's instruction to start reading a document to the start of reading of the document.

In addition, the document placement tray 61 is not placed at the upper limit position but is placed on standby at the predetermined distance PD below the upper limit position, thus forming a gap between the document placed on the document placement tray 61 and the feeding roller 41. This makes it easy to insert or remove a document and use the cursors 22. Thus, it is possible to reduce the time from the user's instruction to start reading a document to the start of reading of the document while preventing a decrease in convenience relating to arranging the document.

Providing the waiting time WT rather than raising the document placement tray 61 immediately after a document on the document placement tray 61 is detected allows the user to secure time to arrange the document. The time required to arrange the document can be more reliably secured because the document placement tray 61 does not start to be raised also when the document width guides 23 are being operated and the cursors 22 are moving.

Moreover, the document placement tray 61 is lowered to the lower limit position when a document has been removed from the document placement tray 61 without an instruction to read the document and therefore the situation where the document placement tray 61 remains unnecessarily at the standby position can be quickly resolved.

For example, if the document placement tray is raised to the upper limit position and the document placed on the document placement tray is kept pressed against the feeding roller, it is difficult to insert or remove a document and use the cursors to align the document in the width direction, thus reducing convenience.

On the other hand, the above embodiment can reduce the time from the user's instruction to start reading a document to the start of reading of the document while preventing a decrease in convenience relating to arranging the document.

The present disclosure is not limited to the configuration of the above embodiment and various modifications are possible. For example, although in the above embodiment, the controller 100 of the control device 10 of the image forming apparatus 1 has been described as an example of the controller in the claims, the document transport device 6 may be provided with a transport controller formed of a CPU or the like that controls overall operations of the document transport device 6 and the transport controller may perform each processing performed by the controller 100 described above with reference to FIG. 8 and thus the transport controller may be implemented as an example of the controller in the claims. The configuration and processing of the above embodiment illustrated using FIGS. 1 to 8 is merely one embodiment of the present disclosure without the intention to limit the present disclosure to the configuration and processing illustrated.

While the present disclosure has been described in detail with reference to the embodiments thereof, it would be apparent to those skilled in the art that various changes and modifications may be made therein within the scope defined by the appended claims.

What is claimed is:

1. A document transport device comprising:

an operation device configured to receive a document reading instruction;

a document placement tray configured to be raised and lowered with a document placed thereon;

a document detection sensor configured to detect presence or absence of a document on the document placement tray;

a document discharge tray;

a document transport mechanism including a feeding roller provided above the document placement tray and configured to feed a document placed on the document placement tray sheet by sheet and a document reading device configured to read an image of the document fed by the feeding roller, the document transport mechanism being configured to transport the document fed by the feeding roller to a reading position on the document reading device and discharge the document to the document discharge tray;

an elevating mechanism configured to raise the document placement tray from a lower limit position in the raising and lowering of the document placement tray to an upper limit position where a top surface of an uppermost sheet of the document placed on the document placement tray is pressed against the feeding roller; and a controller configured to, when the document detection sensor has detected a document on the document placement tray, control driving of the elevating mechanism to temporarily raise the document placement tray to the upper limit position and then move the document placement tray from the upper limit position to a standby position which is a predetermined distance below the upper limit position and stop moving the document placement tray, and when the document transport mechanism has transported the document fed by the feeding roller to the reading position upon the operation device receiving a document reading instruction, cause the elevating mechanism to raise the document placement tray again to the upper limit position, wherein the standby position is set to a predetermined position between the upper limit position and the lower limit position, wherein the document placement tray includes:

a document placement table on which a document is placed;

a cursor formed on a top surface of the document placement table such that the cursor is slidable in a document width direction perpendicular to a document transport direction; and a document width guide that is provided upright on the cursor and comes into contact with the document placed on the document placement table in the document width direction to regulate a width of the document, and the controller is configured not to start the raising of the document placement tray when the cursor is moving.

2. The document transport device according to claim 1, wherein the controller is configured to cause the elevating mechanism to raise and lower the document placement tray with the standby position set to a position that is between the upper limit position and the lower limit position and closer to the upper limit position than to the lower limit position.

3. The document transport device according to claim 1, wherein the controller is configured to, when a document on the document placement tray is not detected by the document detection sensor, control driving of the elevating mechanism to lower the document placement tray that has been on standby at the standby position to the lower limit position.

4. An image forming apparatus comprising:

the document transport device according to claim 1; and an image forming device configured to form an image on a recording medium.

5. A document transport device comprising:

an operation device configured to receive a document reading instruction;

a document placement tray configured to be raised and lowered with a document placed thereon;

a document detection sensor configured to detect presence or absence of a document on the document placement tray;

a document discharge tray;

a document transport mechanism including a feeding roller provided above the document placement tray and configured to feed a document placed on the document placement tray sheet by sheet and a document reading device configured to read an image of the document fed by the feeding roller, the document transport mechanism being configured to transport the document fed by the feeding roller to a reading position on the document reading device and discharge the document to the document discharge tray;

an elevating mechanism configured to raise the document placement tray from a lower limit position in the raising and lowering of the document placement tray to an upper limit position where a top surface of an uppermost sheet of the document placed on the document placement tray is pressed against the feeding roller; and a controller configured to, when the document detection sensor has detected a document on the document placement tray, control driving of the elevating mechanism to temporarily raise the document placement tray to the upper limit position and then move the document placement tray from the upper limit position to a standby position which is a predetermined distance below the upper limit position and stop moving the document placement tray, and when the document transport mechanism has transported the document fed by the feeding roller to the reading position upon the operation device receiving a document reading instruction, cause the elevating mechanism to raise the document placement tray again to the upper limit position, wherein the standby position is set to a predetermined position between the upper limit position and the lower limit position, wherein the controller is configured to raise the document placement tray to the upper limit position after a predetermined time elapses from when the document detection sensor detects a document on the document placement tray, and wherein the document placement tray includes:

a document placement table on which a document is placed;

a cursor formed on a top surface of the document placement table such that the cursor is slidable in a document width direction perpendicular to a document transport direction; and a document width guide that is provided upright on the cursor and comes into contact with the document placed on the document placement table in the document width direction to regulate a width of the document, and the controller is configured to temporarily stop measuring the predetermined time while the cursor is moving.

* * * * *